US005520558A

United States Patent [19]

Kobayashi

[11] Patent Number: 5,520,558

[45] Date of Patent: May 28, 1996

[54] JET PROPULSION UNIT FOR A WATERCRAFT

[75] Inventor: Noboru Kobayashi, Iwata, Japan

[73] Assignee: Yamaha Hatsadoki Kabushiki Kaisha, Iwata, Japan

[21] Appl. No.: 347,824

[22] Filed: Dec. 1, 1994

[51] Int. Cl.[6] ..... B63H 11/00

[52] U.S. Cl. ..... 440/38; 440/75

[58] Field of Search ..... 440/38, 40, 41, 440/42, 43, 47, 75; 114/151

[56] References Cited

U.S. PATENT DOCUMENTS 3,478,712 11/1969 Fox ..... 440/41

3,601,989 8/1971 Austin ..... 440/75

*Primary Examiner*—Jesus D. Sotelo

*Attorney, Agent, or Firm*—Knobbe, Martens, Olson & Bear

[57] ABSTRACT

A number of compact jet pump and prime mover propulsion units for watercraft. In each embodiment the jet propulsion unit impeller shaft is driven by a prime mover that is disposed at least in part below the jet propulsion unit and which has its output shaft disposed no higher than the jet propulsion unit impeller shaft axis. Various transmission arrangements are disclosed, as are in-line and V-type engines.

19 Claims, 6 Drawing Sheets

JET PROPULSION UNIT FOR A WATERCRAFT

BACKGROUND OF THE INVENTION

This invention relates to a jet propulsion unit for a watercraft and more particularly to an improved compact jet pump and prime mover therefor.

The use of jet propulsion units for watercraft is widely accepted and continues to expand. With these types of units a prime mover, normally an internal combustion engine, powers a jet pump which draws water from the body of water in which the watercraft is operating and discharges it through a discharge nozzle for providing a propulsion force for the watercraft. This type of propulsion unit has a number of advantages in that it permits operation in relatively shallow water, provides a neat and compact assembly and has other advantages.

With the conventional type of construction the jet pump has an impeller shaft that extends generally forwardly, frequently through the water inlet opening of the jet pump. The impeller shaft is coupled to the output shaft of the prime mover for driving it. Normally the prime mover is positioned at the front of the jet pump and thus the jet pump and the prime mover are in longitudinally aligned positions. Frequently the prime mover will be disposed forwardly of the transom and the jet pump will be disposed at least in part rearwardly of the transom.

There are, however, many instances when it is desirable to provide the jet pump also forwardly of the transom. This is done normally by mounting the jet pump at least in part in a tunnel formed at the center and to the rear of the hull. Such an arrangement provides a very neat overall configuration of the watercraft and also reduces its effective length. However, where the engine is disposed forwardly of the jet pump then the engine, jet pump combination can intrude significantly into the cockpit area of the watercraft.

It is, therefore, a principle object of this invention to provide an improved and compact jet propulsion unit and prime mover unit for a watercraft.

It is a further object of this invention to provide an improved jet propulsion unit and prime mover wherein the prime mover and jet propulsion unit are disposed in a side-by-side or top-to-bottom relationship so as to reduce the overall length of the assembly.

One problem with jet propulsion units is that the maximum permissible speed of the impeller is somewhat limited. The reason for this is that if the impeller is driven at too high a speed, then, cavitation can result and the pump efficiency deteriorates.

On the other hand, in order to provide a compact propulsion unit, particularly if internal combustion engines are employed, it is desirable to operate the engine at a high speed to achieve a high power output from a low displacement. This results in an incompatibility of the speed of the engine output shaft and the impeller shaft.

It is, therefore, a still further object of this invention to provide an improved jet propulsion unit and prime mover therefor, that incorporates a compact construction and also a transmission that permits the engine output shaft to be run at a higher speed than the impeller shaft.

SUMMARY OF THE INVENTION

This invention is adapted to be embodied in a jet propulsion prime mover unit for a watercraft. The unit is comprised of a jet pump that has an outer housing defining a water inlet opening that is adapted to receive water from the body of water in which the watercraft is operating. The outer housing further includes an impeller housing to the rear of the water inlet and in which an impeller is journaled on an impeller shaft for pumping water through the water inlet. To the rear of the impeller housing is disposed a discharge nozzle through which the water pumped by the impeller is discharged for generating a propulsion force to the associated watercraft. The impeller shaft rotates about a generally horizontally disposed axis. A prime mover is provided that has an output shaft that is rotatable about an axis that is disposed no higher than the impeller shaft axis and which drives the impeller shaft through a transmission.

Another feature of the invention is adapted to be embodied in a jet propulsion prime mover unit of the type described in the preceding paragraph. In accordance with this feature of the invention, the prime mover is positioned so that its output shaft extends in side-by-side relationship to the impeller shaft and drives the impeller shaft through a transmission.

DETAILED DESCRIPTION OF THE PREFERRED EMBODIMENTS OF THE INVENTION

Figure 1:
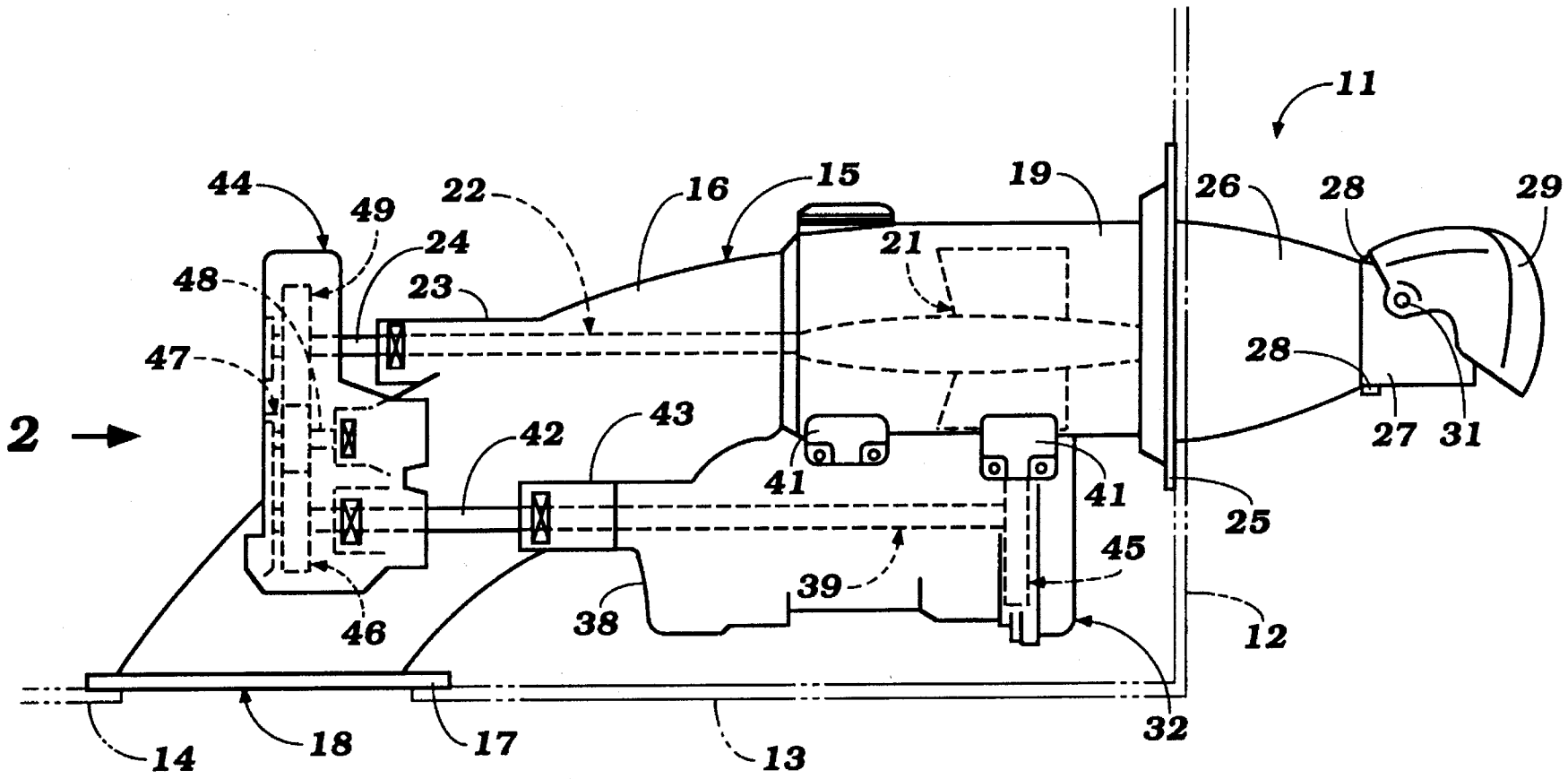
FIG. 1 is a side elevational view of a jet propulsion, prime mover unit constructed in accordance with a first embodiment of the invention, showing the unit embodied in a watercraft that is illustrated partially and shown in phantom.
Figure 2:
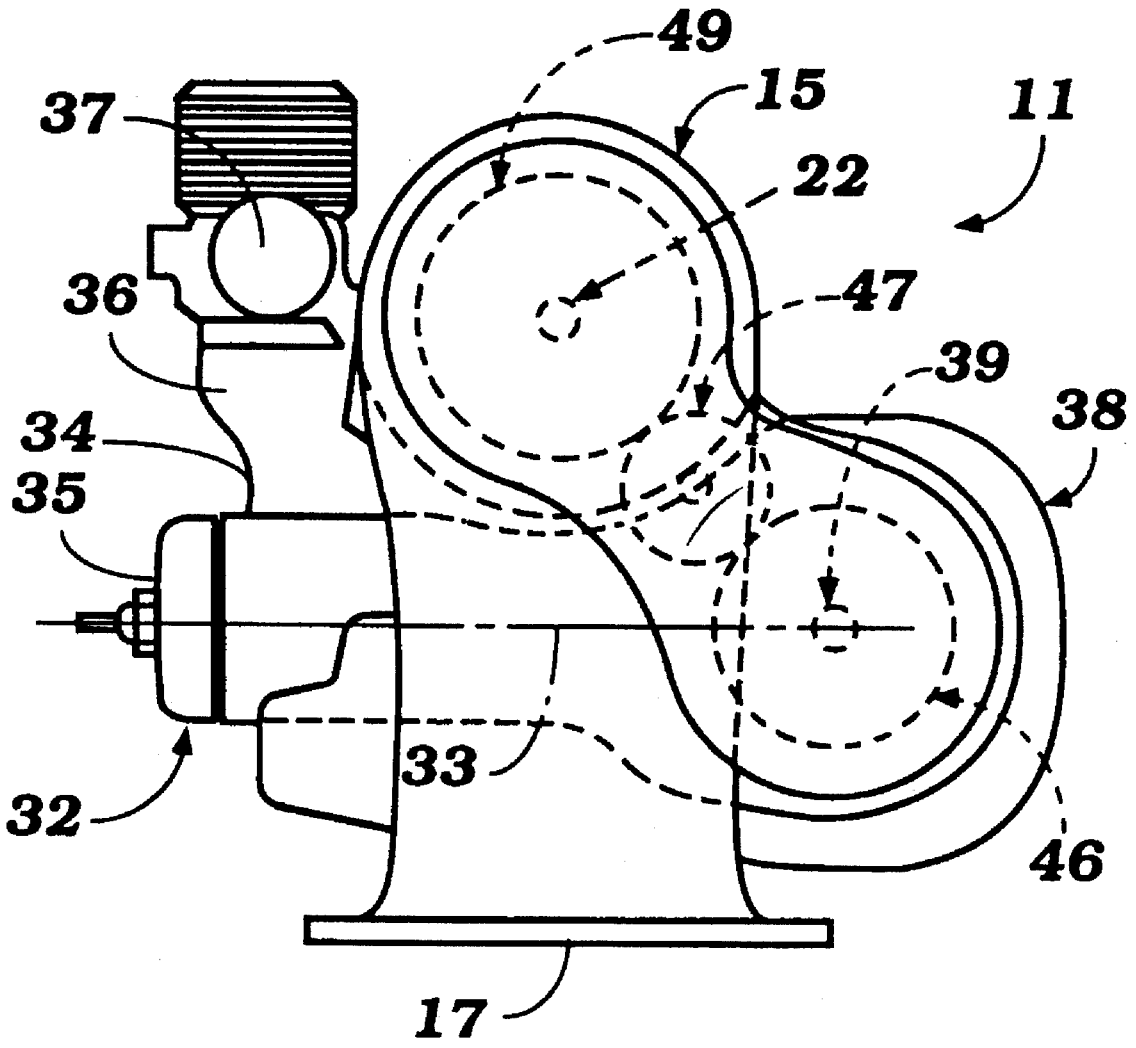
FIG. 2 is a front elevational view of the jet propulsion prime mover unit of this embodiment.

Referring now in detail to the drawings and initially to the embodiment of FIGS. 1 and 2, a jet propulsion, prime mover unit constructed in accordance with a first embodiment of the invention is identified generally by the reference numeral 11. As will become apparent, the jet propulsion prime mover unit is particularly adapted for use in propelling a watercraft and may be mounted therein as shown in phantom in FIG. 1.

The watercraft is shown partially and in phantom and includes a transom 12 positioned at the rear of a hull underside 13. The hull 13 has a opening 14 for water induction, in a manner to be described.

The unit 11 is comprised of a jet propulsion unit having an outer housing 15 and which is positioned within the hull forwardly of the transom 12 and above the hull undersurface 13. The jet propulsion unit outer housing 15 includes a water inlet portion 16 that terminates in a flange 17 that is affixed to the hull 13 in registry with its opening 14. The flange 17 defines an water inlet opening 18 through which water may be drawn into the water inlet portion 16.

An impeller housing 19 is formed by the outer housing assembly 15 to the rear of the water inlet portion 16. An impeller 21 is affixed to an impeller shaft 22 and is journaled for rotation is the impeller housing portion 19. The manner of journaling the impeller shaft 22 and impeller 21 may be of any known type and it should be noted that the impeller shaft 22 extends forwardly through a pilot portion 23 formed in the water inlet portion 16 and has a part thereof 24 that extends forwardly the exterior of the outer housing 15. A suitable seal is provided around the impeller shaft portion 24 and the pilot portion 23 of the water inlet portion 16.

The impeller portion 19 of the housing is provided with a flange 25 that is suitably affixed to the transom 12. A discharge nozzle portion 26 extends through an opening in the transom 12 and partially rearwardly thereof. A steering discharge nozzle assembly 27 is disposed on the rear end of the discharge nozzle 26 and is pivotably supported thereon for steering movement about a vertically extending steering axis by means of a pair of pivot pins 28. The steering nozzle 27 is steered by a suitable steering control for changing the direction of discharge of the water from the steering nozzle 27 and thus providing a steering effect for the associated watercraft.

A reverse thrust bucket 29 is pivotably supported on the steering nozzle 27 by means of horizontally extending pivot pins 31. The reverse thrust bucket 29 is pivotable from a forward drive position to the reverse drive position as shown in FIG. 1. In this position, the water discharge from the discharge nozzle 26 through the steering nozzle 27 would be directed downwardly and forwardly so as to generate a reverse thrust on the associated watercraft, as is well known in this art.

In accordance with a feature of the invention, a prime mover in the form of an internal combustion engine, indicated generally by the reference numeral 32, is affixed to the jet propulsion unit outer housing 15 and suspended from it in such a way so as to provide a compact assembly. The engine 32 may be of any known type and in this embodiment is illustrated of being of the in line type having one or more aligned cylinders having axes 33 that pass below the axis of the impeller shaft 22 and which extends generally horizontally.

A cylinder block 34 of the engine 32 extends beneath the jet propulsion unit outer housing 15 and its cylinder head assembly is disposed at one side thereof. An induction system such as an intake manifold 36 and carburetor 37 can supply a fuel air charge to the engine either through the cylinder head assembly 35 if the engine 32 is of the four cycle type or through its crankcase assembly, indicated generally by the reference numeral 38 if of the two cycle type. The crankcase assembly 38 is disposed on the side of the jet propulsion unit outer housing 15 opposite from the cylinder head 35. A crankshaft, indicated at 39 is journaled for rotation in the crankcase assembly 36 and is driven by the pistons that reciprocate in the cylinder bores of the cylinder block 34 in a well known manner.

The engine 32 is mounted, as aforenoted, from the jet propulsion unit outer housing 15 in a suitable manner and a pair of elastic engine mounts, indicated generally by the reference numeral 41, are provided for this purpose. These engine mounts 41 are affixed to the crankcase assembly 38 and it should be noted that suitable engine mount may be mounted on the other side of the jet propulsion unit outer housing 15.

The crankshaft 39 rotates about an axis that is parallel to, below and to one side of the axis of rotation of the impeller shaft 22 as clearly shown in FIG. 2. The crankshaft 39 has a forwardly extending portion 42 that extends outwardly of a seal assembly 43 fixed at one end of the crankcase 38 and which enters a transmission case 44 that is affixed to or formed integrally with the forward end of the impeller shaft housing 15 and specifically the water inlet portion 16 thereof.

A flywheel 45 which may include a flywheel magneto assembly (not shown) and starter gear is fixed to the end of the crankshaft 39 opposite the extending end 42. The flywheel 45 has a diameter such that it can be slightly greater than the vertical distance between the cylinder bore axis 33 and the axis of the impeller shaft 22 due to the offset relationship.

The transmission case 44 includes a transmission for driving the impeller shaft 22 and specifically its extending portion 24 from the crankshaft portion 42. This transmission includes a first spur gear 46 that is affixed to the crankshaft portion 42 in the transmission case 44. This spur gear 46 engages a further gear 47 that is also contained within the transmission case 44 and which is journaled on an idler shaft 48. A further gear 49 is affixed to the impeller shaft portion 24 within the transmission case 44 and is enmeshed with the gear 47 for completing the transmission of power from the crankshaft 39 to the impeller shaft 22. This transmission comprised of the gears 46, 47 and 49 may have any desired speed ratio including a step down transmission, as illustrated, so that the impeller shaft 22 will rotate at a speed that is less than the speed of the crankshaft 39. This permits the engine 32 to be made compact in construction and rotate at a high rotational speed so as to achieve maximum power for its displacement. By stepping down this speed ratio, the impeller 21 may rotate at a speed low enough to avoid cavitation.

In addition to providing a compact propulsion unit the embodiment thus far described also provides a propulsion unit that has a relatively low center of gravity. That is, the mass of the engine 32 is disposed substantially entirely below the axis of the impeller shaft 22. Thus, the center of gravity can be lowered from prior art type of constructions wherein the engine output shaft is on the same vertical plane as the impeller shaft 22.

Figure 3:
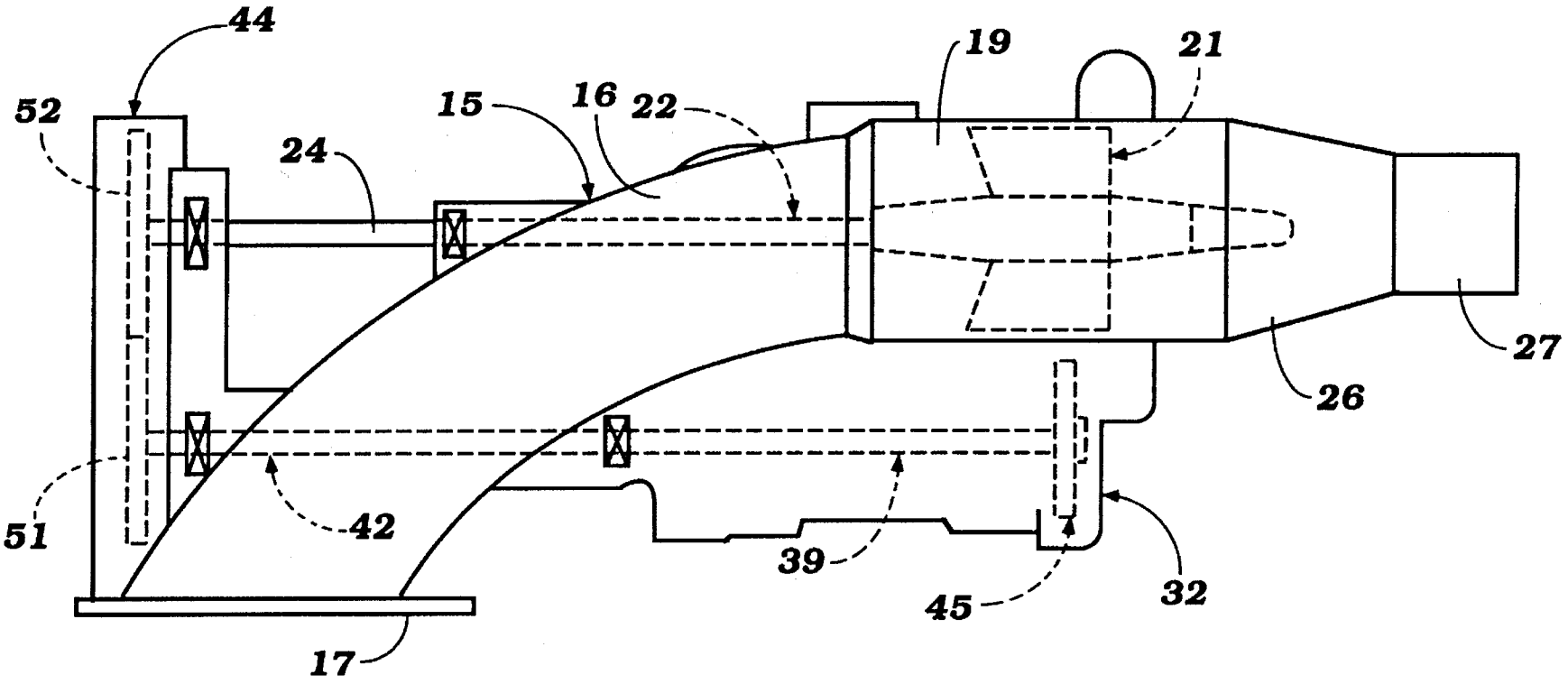
FIG. 3 is a side elevational view, in part similar to FIG. 1 and shows a second embodiment of the invention but in this figure the watercraft is not depicted.

FIG. 3 illustrates another embodiment which is generally the same as the embodiment of FIGS. 1 and 2. For that reason, components of this embodiment which are the same or substantially the same as the previously described embodiment have been identified by the same reference numerals and will be described again only insofar as is necessary to understand the construction and operation of this embodiment.

In this embodiment, the engine 32 is disposed so that its crankshaft 39 rotates about an axis which, like the previously described embodiment is disposed below the axis of rotation of the impeller shaft 22. In this embodiment, however, the axis of the crankshaft 39 lies in a common vertical plane with the axis of the impeller shaft 22 and thus the extending portion 42 of the crankshaft 39 also extends through the water inlet housing 16 of the jet propulsion unit outer housing 15.

In this arrangement, only a pair of spur gears 51 and 52 are affixed to the crankshaft portion 42 and impeller shaft portion 24 so as to provide a single step-down within the transmission case 44. This eliminates one shaft but still permits the capability of having a speed reduction between the crankshaft 39 and the impeller shaft 22. In addition, and if desired, because there is a single gear reduction, the impeller shaft 22 rotates in an opposite direction from the crankshaft 39 and this may be used for balancing purposes.

Figure 4:
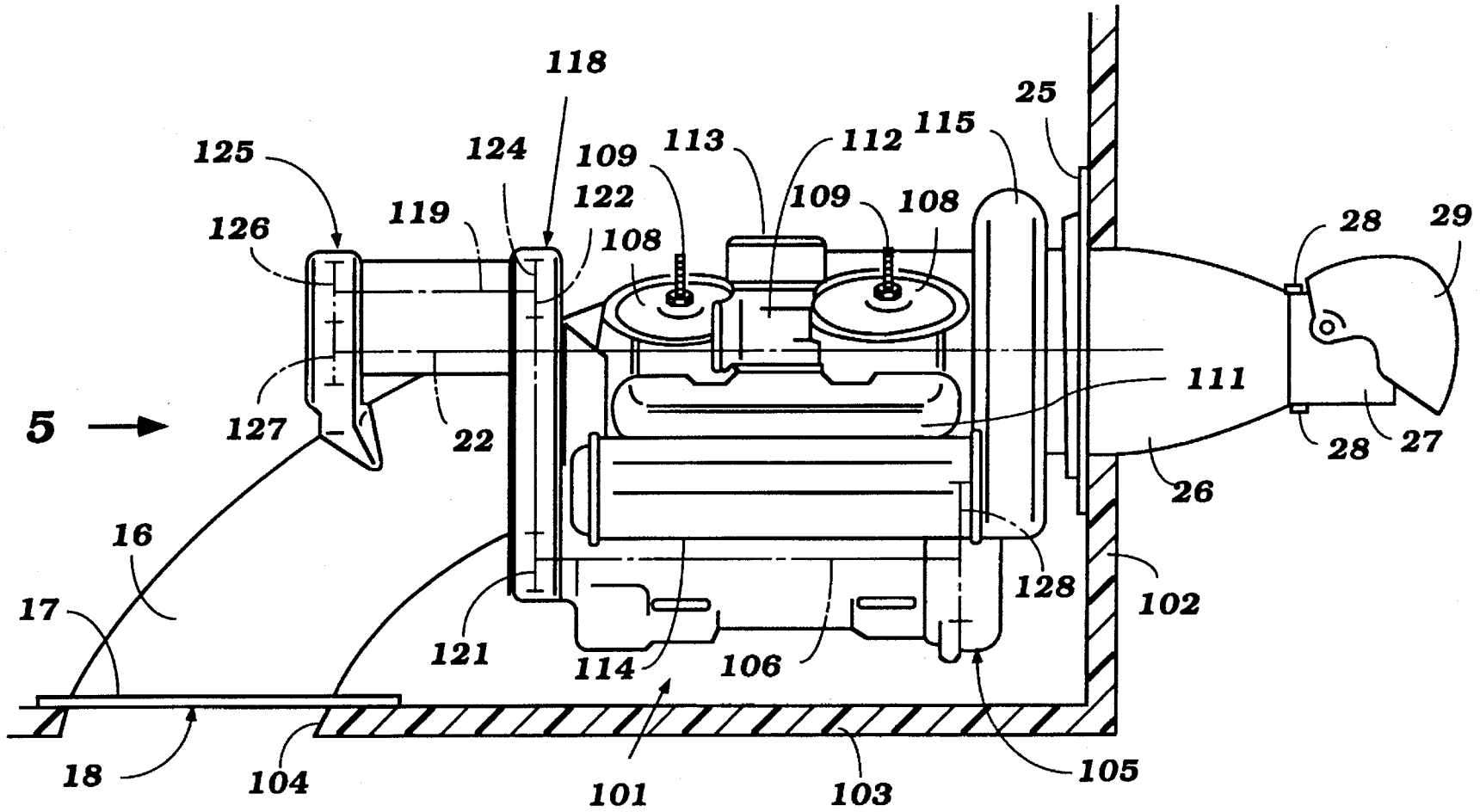
FIG. 4 is a side elevational view, in part similar to FIGS. 1 and 3 and shows a third embodiment of the invention as installed in a watercraft which is shown partially and in cross section.
Figure 5:
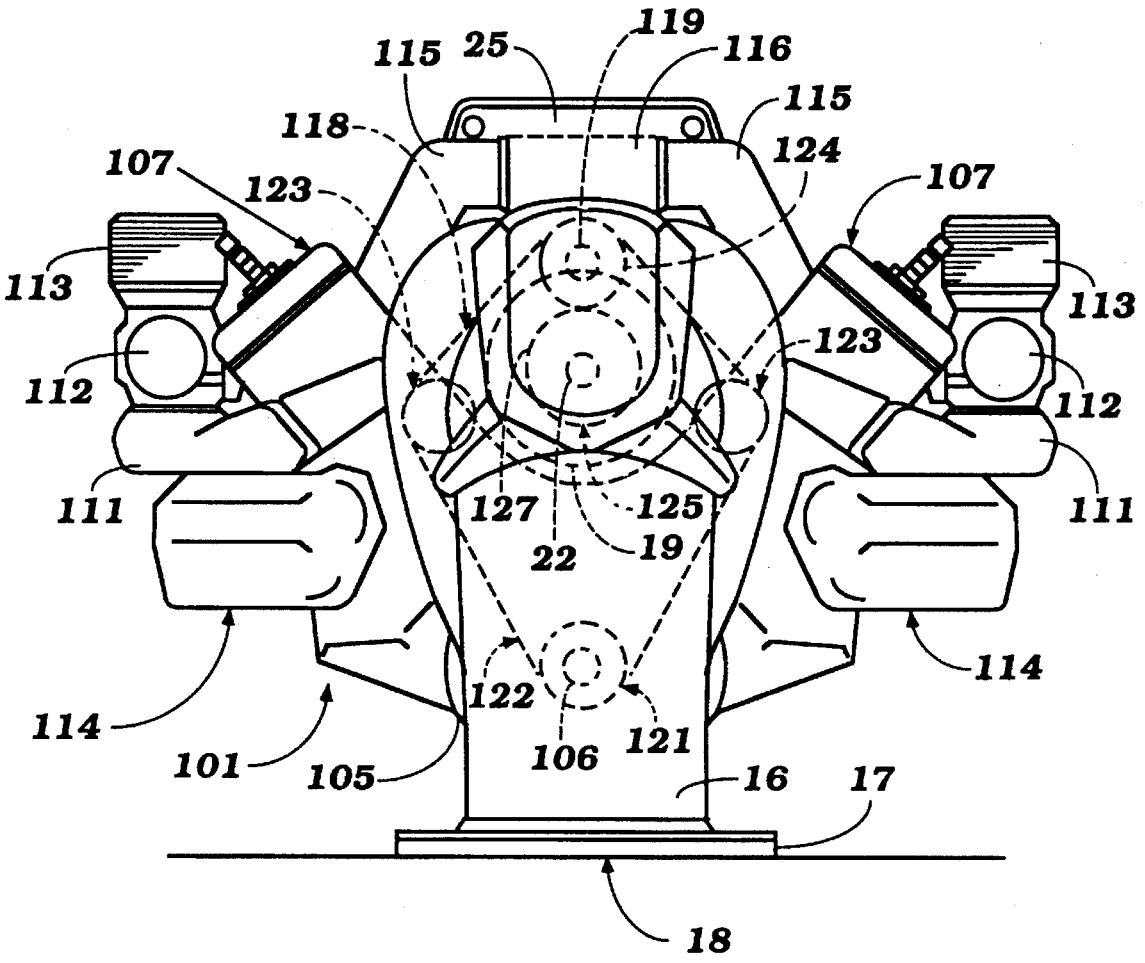
FIG. 5 is a front elevational view of this embodiment looking in the direction of the Arrow 5 in FIG. 4.
Figure 6:
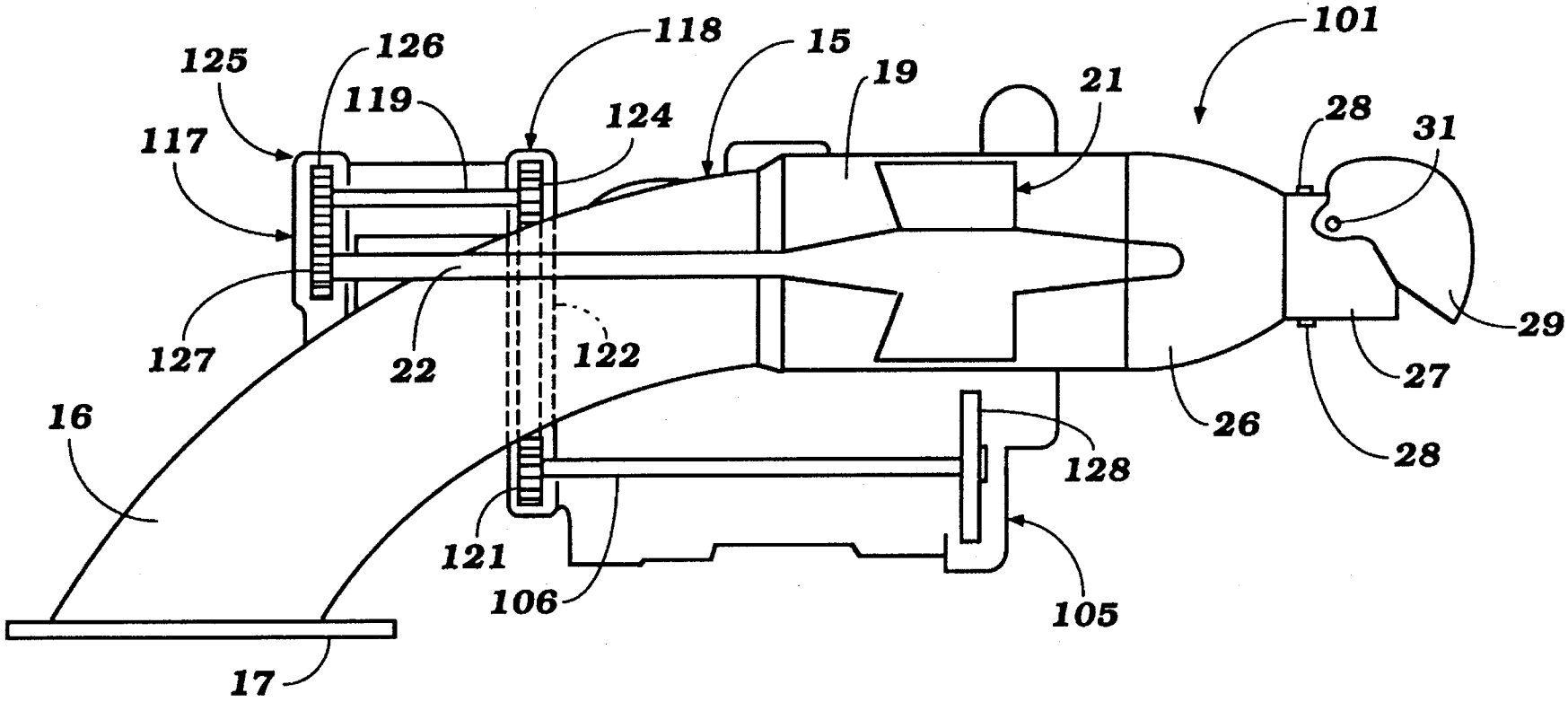
FIG. 6 is a side elevational view, in part similar to FIG. 4 that shows the transmission mechanism in solid lines and deletes the depiction of the watercraft and hull.

A jet pump and prime mover unit constructed in accordance with a third embodiment of the invention is shown in FIGS. 4 through 6 and is identified generally by the reference numeral 101. The unit 101 is depicted in FIG. 4 as being mounted in the hull of the watercraft having a transom 102 and hull undersurface 103 in which a water inlet opening 104 are formed. The construction of the jet pump of this embodiment is the same as the embodiments previously described except for the way in which the impeller shaft is driven and the transmission case which is provided. Therefore, the jet pump and its components are identified by the same reference numerals as applied in the previous figures and will be described again in conjunction with this embodiment only insofar as is necessary to understand the construction and operation of this embodiment.

In the embodiments as thus far described, the powering internal combustion engine has been of the in-line type and has had its cylinder block disposed generally horizontally beneath the jet propulsion unit. In this embodiment, a V-type engine is employed, but it is nested around the jet propulsion unit housing 15 in such a manner so as to provide a compact arrangement and low center of gravity.

The engine is comprised of a crankcase assembly 105 that is disposed in substantial part beneath the impeller housing 19 and which rotatably journals a crankshaft 106 for rotation about a horizontally extending axis. This axis is disposed vertically beneath the impeller shaft 22 and lies in the same vertical plane as the impeller shaft 22.

Diverging upwardly from the crankcase 105 are a pair of angularly inclined cylinder banks 107 which extend at a V-angle. The cylinder banks 107 embrace the impeller housing 19 of the jet propulsion unit outer housing 15, as clearly shown in FIG. 5. Although the cylinder banks 107 may contain any number of individual cylinder bores, in the illustrated embodiment each cylinder bank 107 is provided with a pair of cylinder bores having respective cylinder heads 108 in which spark plugs 109 are mounted and fired in a known manner. The internal construction of the engine is not described because it can be of any conventional nature, but in the illustrated embodiment the engine is a two-cycle, crankcase compression engine.

To this end, each cylinder bank 107 is provided with a respective intake manifold 111 which is disposed on the outer side of the cylinder banks 107 to be clear of the jet propulsion unit impeller housing 19. Carburetors 112 are mounted on the intake manifolds 111 and draw air through air intake devices 113 for delivering a fuel, air charge to the crankcase chambers of the cylinder banks 107 in a well-known manner. It should be noted that although the invention is described in conjunction with a carbureted engine, it will be readily apparent to those skilled in the art how the invention can be employed in conjunction with fuel-injected engines having either direct cylinder injection or manifold injection.

A pair of exhaust manifolds 114 are also provided on the outer sides of the cylinder banks 107 and receive the exhaust gases through appropriate exhaust ports in a well-known manner. The exhaust manifolds 114 extend rearwardly to respective collector sections 115, which extend upwardly to the upper portion of the impeller shaft housing 119 and which may discharge the exhaust gases into the discharge nozzle section 26 for silencing by the water flow and discharge back into the atmosphere through the discharge nozzle 26 and steering nozzle 27. The section for accomplishing this exhaust gas discharge is shown in part in FIG. 5 and is identified by the reference numeral 116 and may cooperate with the mounting flange 25 of the jet propulsion unit.

As with the previously described embodiments, a transmission assembly, indicated generally by the reference numeral 117, is disposed at the front of the crankcase 105 for driving the impeller shaft 22 from the engine crankshaft 106. This transmission assembly 117 includes a first stage 118 which is comprised of a flexible transmitter transmission from the crankshaft 106 to an intermediate drive shaft 119.

This first stage 118 comprises a driving sprocket 121 which is affixed to the crankshaft 106 within the case of the transmission 117. This sprocket 121 drives a flexible transmitter 122, which may either be a toothed belt or a chain. In order to clear the impeller housing 119 and the rear end of the water inlet portion 16, there are provided a pair of idler sprockets 123 that are mounted on the transmission case of the transmission portion 118 on diametrically opposite sides of the impeller housing 19, as shown in FIG. 5. From these idler sprockets 123, the flexible transmitter 122 turns inwardly to engage a driven sprocket 124 that is fixed for rotation with the intermediate drive shaft 119. Hence, the intermediate drive shaft 119 is driven from the crankshaft 106 through this first stage 118. The drive ratio may be varied as desired by determining the size of the driving sprocket 121 and the driven sprocket 124. The intermediate drive shaft 119 will rotate in the same direction as the engine crankshaft 106.

The intermediate drive shaft 119 drives a second transmission stage, indicated generally by the reference numeral 125, which is disposed at the forward end of the transmission assembly 117. This second stage is comprised of a first spur gear 126 that is affixed to the forward end of the intermediate drive shaft 119. This spur gear 126 is enmeshed with a further spur gear 127 that is affixed to the forward end of the impeller shaft 22, and thus provides a direct drive to the impeller shaft 122. This drive reverses the direction of rotation of the impeller 121 from the crankshaft 106, and as aforenoted, this may be employed for balancing of vibration-reducing purposes. Again, the ratio between the gears 126 and the ratio of the primary stage 118 may be chosen so that the impeller shaft 22 will be driven at a slower speed than the crankshaft 106 so as to permit high engine rpm's to permit high outputs without causing cavitation.

As with the previous embodiments, a flywheel 128 (FIGS. 4 and 6) may be affixed to the rear end of the crankshaft 106 for damping purposes and to drive a flywheel magneto and/or to accommodate an electric starter mechanism.

It should be readily apparent from the foregoing description that the described embodiments of the invention are very effective in providing a very compact jet propulsion unit and prime mover for powering watercraft. Of course, the foregoing description is that of preferred embodiments of the invention, and various changes and modifications may be made without departing from the spirit and scope of the invention as defined by the appended claims.

I claim:

1. A jet propulsion, prime mover unit for a watercraft comprised of a jet pump having an outer housing defining a water inlet opening adapted to draw water from a body of water in which the watercraft is operating, an impeller housing portion disposed at the end of said water inlet housing and containing an impeller supported for rotation and a discharge nozzle portion disposed to the rear of said impeller portion for discharging water pumped by said impeller, an impeller shaft driving said impeller and rotatably journaled by said jet pump outer housing for rotation about a generally horizontally disposed axis, a prime mover having an output shaft rotatable about an axis disposed vertically below the axis of said impeller shaft, prime mover output shaft and a transmission for driving said impeller shaft from said prime mover output shaft.

2. A jet propulsion, prime mover unit claim 1, wherein the prime mover comprises an internal combustion engine and the engine output shaft comprises a crankshaft.

3. A jet propulsion, prime mover unit claim 2, wherein the crankshaft rotates about an axis that is parallel to the axis of the impeller shaft.

4. A jet propulsion, prime mover unit claim 3, wherein the crankshaft is disposed to one side of a vertical plane containing the impeller shaft axis.

5. A jet propulsion, prime mover unit claim 4, wherein the engine comprises a cylinder block having cylinder bores extending horizontally below the impeller shaft axis.

6. A jet propulsion, prime mover unit claim 3, wherein the engine has a pair of angularly inclined cylinder banks extending upwardly from a crankcase journaling the crankshaft and which cylinder banks are disposed on opposite sides of the impeller housing portion, said crankshaft axis lying in a common vertical plane with the impeller shaft axis.

7. A jet propulsion, prime mover unit claim 6, wherein the cylinder banks have an induction and exhaust system disposed on the sides of the cylinder banks spaced from the impeller housing portion.

8. A jet propulsion, prime mover unit claim 6, wherein the transmission comprises a first stage flexible transmitter transmission that drives an intermediate drive shaft journaled for rotation about an axis disposed in the same plane as the crankshaft and impeller shaft but positioned vertically above the impeller shaft, and a second stage comprising a series of intermeshing gears for driving the impeller shaft from the intermediate drive shaft.

9. A jet propulsion, prime mover unit claim 8, wherein the flexible transmitter drive comprises a pair of idler shafts carrying idler sprockets disposed transversely outwardly of the impeller housing portion so that the flexible transmitter encircles the impeller housing portion.

10. A jet propulsion, prime mover unit claim 3, wherein the transmission drives the impeller shaft so that the impeller shaft rotates in an opposite direction from the crankshaft.

11. A jet propulsion, prime mover unit claim 10, wherein the transmission includes a plurality of intermeshing gears and a flexible transmitter.

12. A jet propulsion, prime mover unit claim 11, wherein the transmission drives the impeller shaft at a lower rate of speed than the crankshaft.

13. A jet propulsion, prime mover unit for a watercraft comprised of a jet pump having an outer housing defining a water inlet opening adapted to draw water from a body of water in which the watercraft is operating, an impeller housing portion disposed at the end of said water inlet housing and containing an impeller supported for rotation and a discharge nozzle portion disposed to the rear of said impeller portion for discharging water pumped by said impeller, an impeller shaft driving said impeller and rotatably journaled by said jet pump outer housing for rotation about a generally horizontally disposed axis, a prime mover having an output shaft rotatable about an axis disposed no higher than the axis of said impeller shaft, said prime mover output shaft and said impeller shaft being disposed in a parallel relationship and a transmission for driving said impeller shaft from said prime mover output shaft.

14. A jet propulsion, prime mover unit claim 13, wherein the transmission is disposed forwardly of the impeller housing portion.

15. A jet propulsion, prime mover unit claim 11, wherein the transmission includes a series of intermeshing gears.

16. A jet propulsion, prime mover unit for a watercraft comprised of a jet pump having an outer housing defining a water inlet opening adapted to draw water from a body of water in which the watercraft is operating, an impeller housing portion disposed at the end of said water inlet housing and containing an impeller supported for rotation and a discharge nozzle portion disposed to the rear of said impeller portion for discharging water pumped by said impeller, an impeller shaft driving said impeller and rotatably journaled by said jet pump outer housing for rotation about a generally horizontally disposed axis, a prime mover having an output shaft rotatable about an axis disposed no higher than the axis of said impeller shaft, and disposed beneath said impeller housing and generally between said water inlet portion and said discharge nozzle portion of the jet pump outer housing and a transmission for driving said impeller shaft from said prime mover output shaft.

17. A jet propulsion, prime mover unit claim 16, wherein the prime mover output shaft and the impeller shaft are disposed in parallel relationship.

18. A jet propulsion, prime mover unit claim 17, wherein the transmission is disposed forwardly of the impeller housing portion.

19. A jet propulsion, prime mover unit claim 18, wherein the transmission includes a series of intermeshing gears.

* * * * *